United States Patent [19]

Cano et al.

[11] Patent Number: 4,887,796

[45] Date of Patent: Dec. 19, 1989

[54] BARBED TAPE

[75] Inventors: Renne A. Cano; Don W. Boness, both of Phoenix, Ariz.; Robert W. Major, Seymour, Conn.; Gabriel A. Valdez, Tolleson, Ariz.

[73] Assignee: American Fence Company, Phoenix, Ariz.

[21] Appl. No.: 126,821

[22] Filed: Nov. 30, 1987

[51] Int. Cl.[4] ..... B21F 25/00

[52] U.S. Cl. ..... 256/8; 256/2

[58] Field of Search ..... 256/8, 2, 9, 7, 6, 11, 256/4, 5

[56] References Cited

U.S. PATENT DOCUMENTS

| | | | |
|---|---|---|---|
| 301,126 | 7/1884 | Jordan | 256/7 X |
| 2,908,132 | 10/1959 | Klemm | 256/8 X |
| 2,908,484 | 10/1959 | Uhl | 256/8 |
| 3,455,539 | 7/1969 | Loofbourrow | 256/8 |
| 3,480,256 | 11/1969 | Simon et al. | 256/8 |
| 3,615,273 | 10/1971 | See | 256/2 X |
| 3,763,529 | 10/1973 | Musgrave | 256/8 X |
| 4,509,726 | 4/1985 | Boggs et al. | 256/8 |
| 4,718,641 | 1/1988 | Mainiero | 256/8 |

*Primary Examiner*—Randolph A. Reese
*Assistant Examiner*—Peter M. Cuomo
*Attorney, Agent, or Firm*—Cahill, Sutton & Thomas

[57] ABSTRACT

Barbed tape made from an elongated metal strip having a plurality of pairs of barbs formed along the edges thereof and the portion of the strip forming each barbed pair has a second pair of barbs formed therein. The first pair of barbs extend in opposite directions away from each other and the second pair of barbs extend in opposite directions but toward each other. The second pair of barbs serve to retain articles impaled on the first pair of barbs.

7 Claims, 1 Drawing Sheet

BARBED TAPE

TECHNICAL FIELD

This invention is concerned with barbed tape of the type used as a security barrier to prevent unauthorized entry or exit of people from secure facilities.

BACKGROUND ART

A particularly effective barrier made from barbed tape is disclosed in U.S. Pat. No. 4,509,726 granted Apr. 9, 1985 to W. G. Boggs, et al for "Barrier". That patent discusses the background and development of barbed tape barriers. It also identifies some of the features desired in such barriers, such as, for example, strength, an intimidating appearance, and the capability of inflicting serious punishment on any person attempting to breech the barrier.

An improvement on the barrier of the Boggs, et al patent is disclosed in the co-pending application for U.S. patent, Ser. No. 079,584, filed July 30, 1987, by R. W. Major for "Barbed Tape Barrier" now U.S. Pat. No. 4,844,422 and assigned to the same assignee as the present application. That application discloses a barbed tape with more effective barb configurations.

Neither of the barbed tapes of the Boggs, et al patent or the Major application possesses any particular capability of retaining articles or human body parts impaled on the barbs. The barbs of these tapes are capable of inflicting severe wounds on a person attempting to breech the barrier, but it is relatively easy for that person to disengage himself or his clothing from the barbed tape and thereby possibly escape detection.

It has been suggested that barbed tapes, or strips, be provided with hook-shaped barbs for increased holding capability. U.S. Pat. No. 3,455,539, granted July 15, 1969 to J. G. Loofbourrow for "Barbed Strip" discloses such a tape. The Loofbourrow strip, however, must be made of expensive tempered spring steel according to the patent and the barb arrangement disclosed is not nearly as effective as the Boggs, et al barrier because all of the Loofbourrow barbs are individually formed rather than in pairs or clusters.

DISCLOSURE OF THE INVENTION

Barbed tape embodying this invention utilizes a plurality of pairs of barbs integrally formed from a strip of metal in the manner taught in the aforementioned Boggs, et al patent and Major application. However, portions of the strip forming each barb pair are cut out to provide a second pair of barbs on the first barb pair. These barbs of the second pair face in a direction generally opposite the respective barbs of the first pair and function to retain articles impaled on the first pair of barbs.

BRIEF DESCRIPTION OF THE DRAWING

The invention is described in greater detail hereinafter by reference to the accompanying drawing wherein.

BEST MODE FOR CARRYING OUT THE INVENTION

Figure 1:
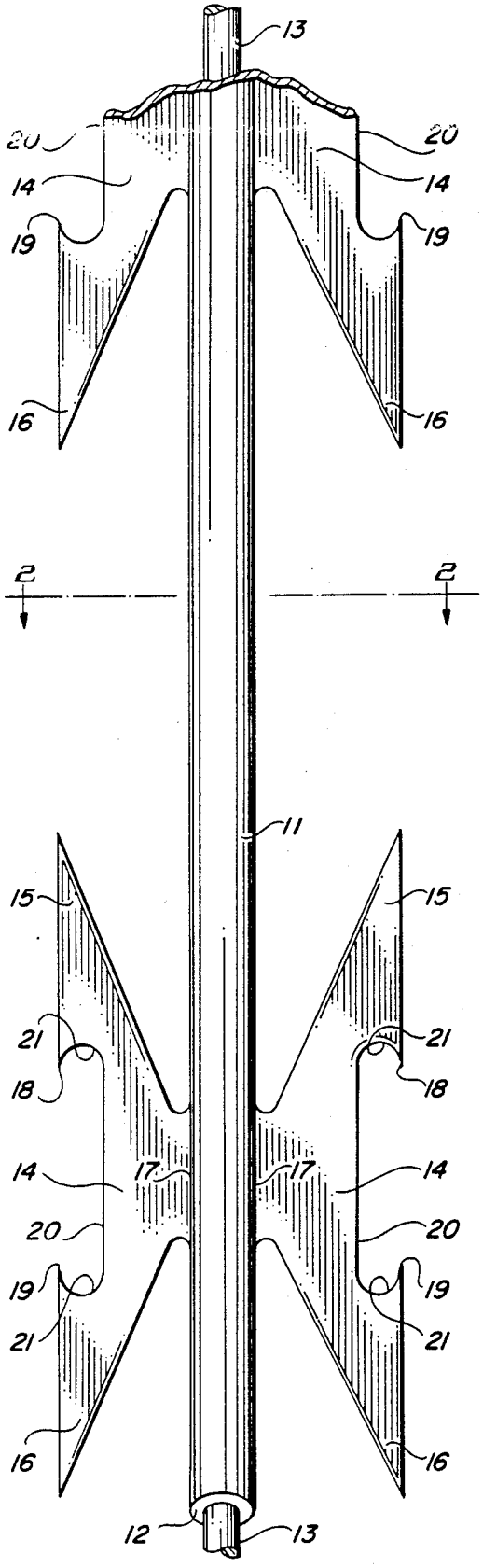
FIG. 1 is a fragmentary plan view of a barbed tape embodying this invention.
Figure 2:
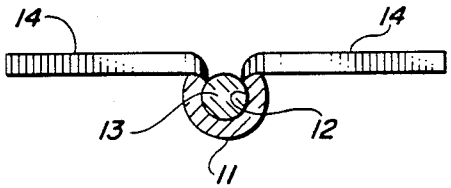
FIG. 2 is a sectional view taken as indicated by line 2—2 in FIG. 1.

Referring particularly to FIGS. 1 and 2 the barbed tape of this invention is blanked from a continuous flat strip of corrosion resistant sheet metal, such as stainless steel. A central portion 11 of the metal strip is continuous and may have a channel 12 formed therein for receiving and gripping a reinforcing wire 13.

The barbed tape is formed, as by stamping, to provide a plurality of barb pairs 14 spaced, along the tape. Each barb pair 14 has a first barb 15 and a second barb 16, which have their points extending in opposite directions and away from each other.

Barb pairs 14 are formed integrally with the central portion 11 of the tape and are joined thereto by root portions 17.

Each barb pair 14 has a second pair of barbs including a third barb 18 and a fourth barb 19 formed therein.

The second pair of barbs 18 and 19 are preferably formed by blanking, or cutting out, to define a central edge, cutout region 20 of each barb pair 14. Each cutout region 20 is configured to provide a curvilinear configuration 21 adjacent each of the barbs 18 and 19.

The arrangement is such that the second pair of barbs 18 and 19 extend in opposite directions, but toward each other, and opposite the direction in which the points of the barbs 15 and 16 with which they are associated extend. In other words, each barb 18 extends in a direction opposite its associated barb 15 and each barb 19 extends in a direction opposite its associated barb 16. Thus, barbs 18 and 19 are configured and positioned to hold, or retain, articles or objects which are impaled on barbs 15 and 16 respectively. This increases the effectiveness of the barbed tape by making it more difficult for a person to disentangle himself from the tape once he has encountered the tape.

Figure 3:
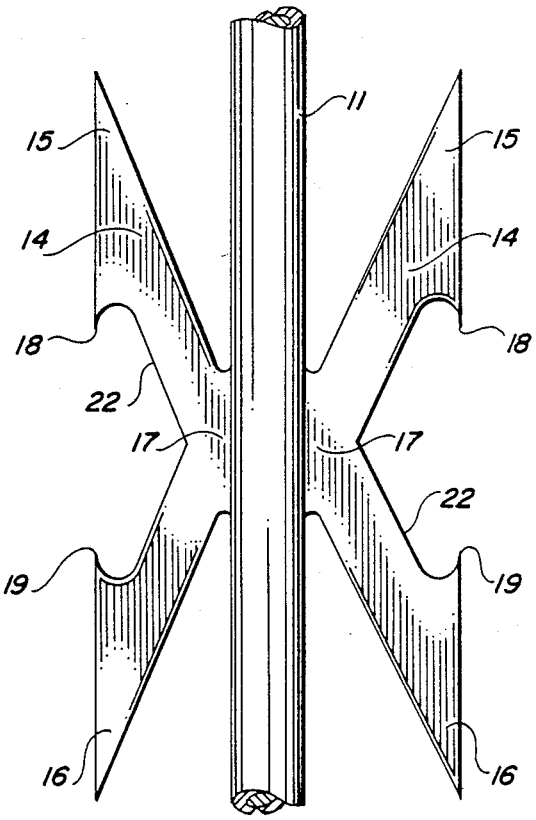
FIG. 3 is a fragmentary plan view of another tape embodying the invention.

The embodiment of the invention illustrated in FIG. 3 has many features in common with the barbed tape illustrated in FIGS. 1 and 2 and described above. Like reference numerals are used in FIG. 3 to identify those common features. For example, the barbed tape in FIG. 3 has a first pair of barbs 15 and 16 thereon and a second pair of barbs 18 and 19 which function as retaining barbs for barbs 15 and 16. The barbed tape of FIG. 3, however, has a different blank, or cutout, region 22 which extends across the face of each barb pair 14 toward the root portion 17 thereof. This enlarged cutout region 22 opens up access to retainer barbs 18 and 19 and thereby increases their effectiveness in impaling and holding articles on barbs 15 and 16.

From the foregoing it should be apparent that this invention improves the effectiveness of barbed tape by providing a barbed configuration which is capable of retaining impaled articles.

What is claimed is:

1. A barbed tape of an elongated metal strip comprising a central portion, a plurality of barb pairs, a root portion joining each one of said barb pairs to said central portion, each of said barb pairs including a first barb and a second barb, said first and second barbs extending in opposite directions away from each other, each of said barb pairs having a second pair of barbs formed therefrom, each one of said second pair of barbs including a third barb and a fourth barb, and said third and fourth barbs extend in opposite directions toward each other to define a cutout region between said third and fourth barbs in said barb pairs.

2. The barbed tape of claim 1 wherein said second pair of barbs defining said cutout region within said barb pairs, are formed by cutting out a region of the metal strip in said barb pairs.

3. The barbed tape of claim 2 wherein the cutout region extends inwardly toward said root portion.

4. The barbed tape of claim 2 wherein the cutout region has a curvilinear configuration adjoining said second pair of barbs.

5. The barbed tape of claim 1 wherein said third barb being associated with said first barb and extending in a direction opposite thereto, and said fourth barb being associated with said second barb and extending in a direction opposite thereto.

6. The barbed tape of claim 5 wherein said first, second, third and fourth barbs are co-planar.

7. The barbed tape of claim 5 wherein said first, second, third and fourth barbs are co-axially disposed.

* * * * *